US005413503A

United States Patent [19]

Salz

[11] Patent Number: 5,413,503

[45] Date of Patent: May 9, 1995

[54] PHONO PLUG

[75] Inventor: David B. Salz, Dania, Fla.

[73] Assignee: Wireworld by David Salz, Inc., Fort Lauderdale, Fla.

[21] Appl. No.: 41,766

[22] Filed: Apr. 1, 1993

[51] Int. Cl.[6] ..... H01R 9/05

[52] U.S. Cl. ..... 439/578; 439/839

[58] Field of Search ..... 439/578, 583, 584, 585, 439/821, 839, 851, 852

[56] References Cited

U.S. PATENT DOCUMENTS

| | | | |
|---|---|---|---|
| 3,295,094 | 12/1966 | De Lyon et al. . | |
| 3,631,373 | 12/1971 | Matrisian | 439/851 X |
| 3,686,625 | 8/1972 | Krehbiel et al. | 439/851 |
| 3,723,949 | 3/1973 | Wallo . | |
| 4,010,538 | 3/1977 | O'Keefe et al. . | |
| 4,897,050 | 1/1990 | Randolph . | |
| 4,966,560 | 10/1990 | Marzonk . | |
| 4,995,836 | 2/1991 | Toramoto . | |
| 5,011,434 | 4/1991 | Blunt . | |
| 5,052,946 | 10/1991 | Homolka . | |

FOREIGN PATENT DOCUMENTS

| | | | |
|---|---|---|---|
| 0811589 | 4/1959 | United Kingdom | 439/584 |

*Primary Examiner*—Eugene F. Desmond

*Attorney, Agent, or Firm*—Malin, Haley, DiMaggio & Crosby

[57] ABSTRACT

A phono plug is provided having an insulator filled and isolated hollow cylindrical center-pin and ground flanges utilizing at least one elastomeric O-ring which is operatively associated with a groove in the outer circumference of the ground flanges. The O-ring helps bias the ground flanges to provide appropriate contact tension between the ground flanges and a receptacle to provide an optimal signal transmission.

18 Claims, 2 Drawing Sheets

PHONO PLUG

BACKGROUND OF THE INVENTION

1. Field of the Invention

The present invention relates generally to coaxial connectors and more particular to an improved phono plug wherein the ground flanges utilize a unique tensioning device.

2. Description of the Prior Art

Coaxial cable connectors are well known in the art. A common problem inherent with prior art connectors is the lack of, or poor amount of, contact between the ground flanges of the phono plug and the phono jack or receptacle when the phono plug is inserted into the receptacle. The problem is partly due to a lack of receptacle standardization (outside diameter tolerances commonly range from 0.322" to 0.330"), resulting in a less than optimal signal transmission through the coupling due to unpredictable conductances. This is primarily a result of improper mechanical coupling between the ground flanges and the receptacle.

Prior art attempts to overcome this problem include the use of natural or induced spring tension of soft metal flanges, such as brass, typically yielding a fit which is either too loose or too tight on some common diameter receptacles. Additionally, because inherent spring tension is needed, other more conductive metals, such as copper or silver, are unavailable because of inadequate biasing ability.

Another device known in the art makes use of a locking collet device to tighten the flange against the receptacle once the plug is inserted into the receptacle. These locking-collet type phono plugs can accommodate a broad range of receptacle diameters and increase the contact between the flanges and receptacle, but are awkward and inconvenient to use.

Additionally, it is common to find phono plugs with either a solid or hollow center pin. Having a hollow center pin provides for better electrical characteristics than a solid center pin. The hollow center pin is a better conductor and provides a more distinct pathway for high frequencies. However, one problem with using a hollow center pin is that air space inside the pin becomes filled with solder when the wire from the coaxial cable is soldered to the pin, causing an unknown, inconsistent electrical characteristics to occur.

Therefore, there exist a need in the industry to provide a phono plug which overcomes the problems described above, by providing greater contact area and a superior contact surface between the flanges and the jack and the prevention of solder from becoming disposed within the hollow center pin thus providing improved conducting characteristics.

SUMMARY OF THE INVENTION

The present invention overcomes the above described problems by providing a novel phono plug having an insulator filled and isolated hollow cylindrical center-pin, and ground flanges utilizing at least one elastomeric O-ring which is operatively associated with a groove in the outer circumference of the ground flanges. The O-ring providing a means for biasing the flanges in conjunction with an outer cover to optimize the grip of the flanges. Thus, the contact between the flanges and the receptacle is optimized allowing the flanges to be made of more conductive metals, such as copper or silver, not previously available with conventional designs. Furthermore, no additional parts, such as a collet, are required once the phono plug has been inserted into the receptacle.

An additional groove at the base of the flanges may be utilized to allow the flexibility of the flanges to be adjusted to achieve the desired results. For purposes of example only, the preferred inside diameter of the flanges is slightly oversized allowing the elastomeric tensioning or biasing device to provide the appropriate contact tension and repeatability on an entire range of the phono jack diameters to provide an optimal signal transmission.

Lastly, an insulator is disposed within at least a portion of the center pin to prevent any solder from entering the inside of the center pin when soldering the wire from the coaxial cable to the pin. Preferably, the insulator is teflon tubing. The teflon insulator inside the pin preserves the inherent advantage of low "skin-effect" provided by the tubular structure of the pin.

Accordingly, the primary object of the present invention is to provide a phono plug with a repeatable contacting surface between the flanges of the phono plug and the receptacle.

It is another object of the present invention to provide a phono plug which will provide a superior contact surface with a range of phono jack diameters.

It is a further object of the present invention to provide a phono plug which has a greater contact area.

It is yet another object of the present invention to provide a phono plug which will prevent solder from entering the inside of the center pin when soldering the wire from a coaxial cable to the center pin.

Yet still another object of the present invention is to provide a phono plug with optimal electrical characteristics.

It is a further object of the present invention to provide a phono plug which is relatively low in cost and easy to manufacture.

These and other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE PREFERRED EMBODIMENT

Figure 1:
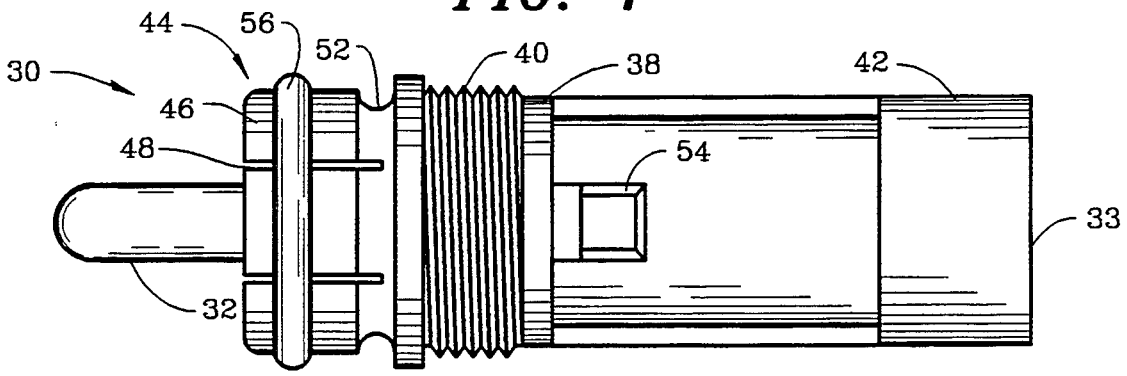
FIG. 1 is a top view of the phono plug in accordance with the present invention.

Referring now to the drawings, the coaxial connector of the instant invention is generally shown by reference numeral 10 which comprises a housing 12 and a phono plug 30. Outer surface 14 of housing 12 can be formed into various shapes while inner surface 16 of the housing 12 is cylindrical. Internal threads 18 can be provided on a portion of inner surface 16 of housing 12 for engagement with the external threads 40 of plug 30, when plug 30 is inserted within housing 12.

Phono plug 30 is similar to a conventional phono plug and generally comprises a hollow tubular body member 31 having a continuous sidewall 37 and a hollow cylindrical center pin 32. Center pin 32 is firmly held by an annular insulating separator 34 tightly disposed within a central section 36 of body member 31. External threads 40 are disposed on a portion of the outer surface 38 of central section 36. A first end 54 of center pin 32 extends through annular insulating separator 34 for receiving an exposed leading portion of a center conductor of a coaxial cable (not shown). The exposed leading portion is operatively associated with the first end 54 of center pin 32 by means common in the industry, such as soldering. First end 54 is accessed by removing or cutting out a portion of 60 of the sidewall of central section 36 of body member 31. Removing portion 60 of central section 36 provides access to first end 54 of center pin 32. A tubular cable aligning member 42 is shown at first end 33 of body member 31. The exposed leading portion of the coaxial cable is inserted through cable aligning member 42 before being operatively associated with the first end 54 of center pin 32.

A plurality of cantilevered ground flanges 46 are attached to central section 36 and are separated from each other by horizontal slits 48. Slits 48 extend from the distal ends of the ground flanges 46 to the proximal ends of the ground flanges 46 and extend through the flanges 46 from the inner surface to the outer surface of flanges 46. At least one groove 50 is disposed about the outer circumference of flanges 46.

Figure 4:
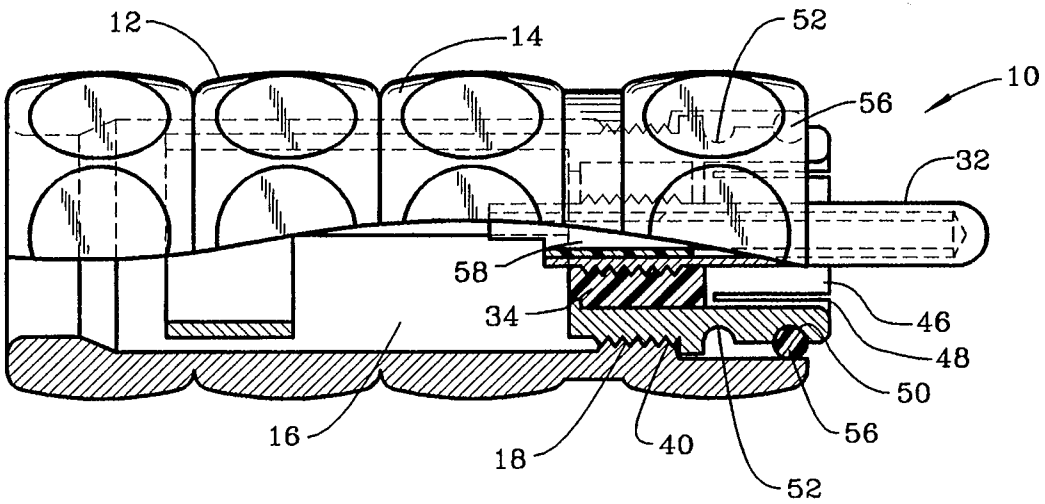
FIG. 4 is a is top view of the coaxial connector with a portion of the housing cut away to show the phono plug within the housing.

An O-ring 56 is provided which is operatively associated with groove 50 in the outer circumference of flanges 46. As best seen in FIG. 4, O-ring 56, being resilient in nature, provides a means for biasing the flanges, generally shown at 44, in conjunction with the inner surface 16 of housing 12. Thus, the contact between flanges 46 and the receptacle (not shown) is optimized allowing flanges 46 to be made of more conductive metals, such as copper and silver.

A second groove 52 can be provided at the base of flanges 46 to allow the flexibility of flanges 46 to be further adjusted to achieve the desired results. Second groove 52 can also be used to store a spare O-ring.

Preferably, the inside diameter of flanges 46 is nominally 0.330'. This diameter use in conjunction with the elastomeric tensioning of O-ring 56 provides appropriate contact tension between flanges 46 and the receptacle to provide an optimal transmission.

In assembly, O-ring 56 is placed within groove 50 and flanges 46 are squeezed inward until they are touching at their respective ends to one another. This squeezing provides clearance for placing barrel or housing 12 over plug 30 and O-ring 56 and for screwing or engaging the internal threads 18 of housing 12 with the external threads 40 of phono plug 30.

The initial placement of O-ring 56 within groove 50 immediately acts to provide biasing of flanges 46. As plug 30 is turned within housing 12, the inner surface 16 of housing applies pressure upon O-ring 56 thus further biasing flanges 46 and providing appropriate contact tension between flanges 46 and the receptacle. The assembly process is completed by inserting phono plug 30 into the receptacle which causes flanges 46 to be pushed outward and set to their normal position.

Figure 2:
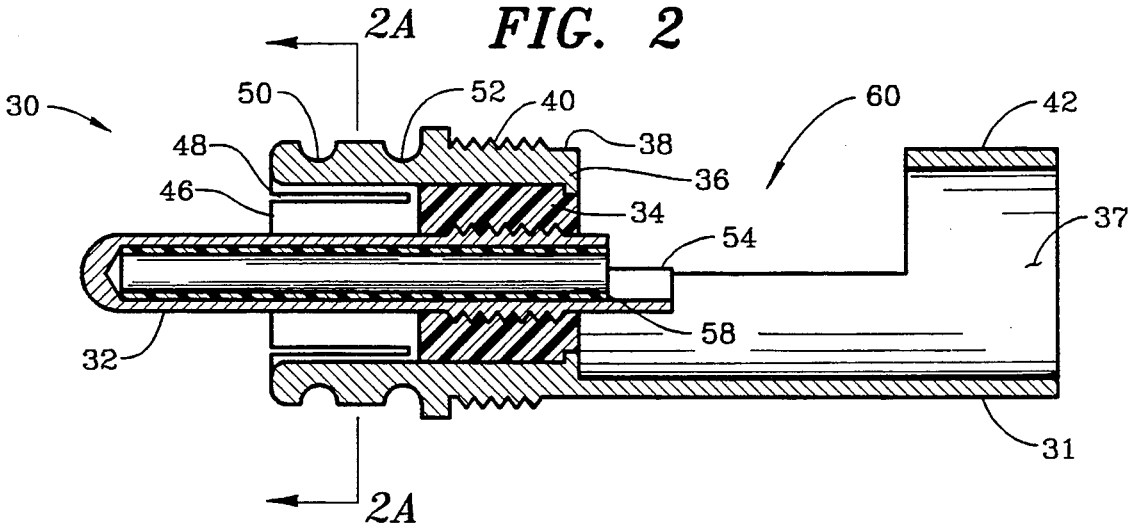
FIG. 2 is a cross sectional view of the phono plug of FIG. 1.
Figure 2A:
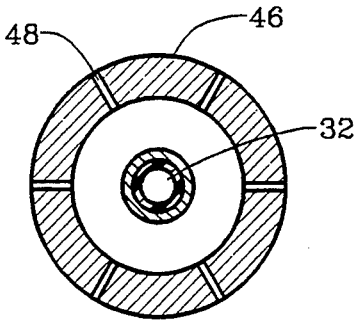
FIG. 2*a* is a side view of the phono plug of FIG. 1.
Figure 3A:
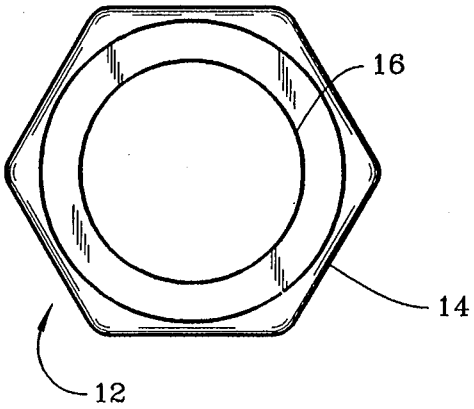
FIG. 3*a* is a side view of the housing of FIG. 3.
Figure 3:
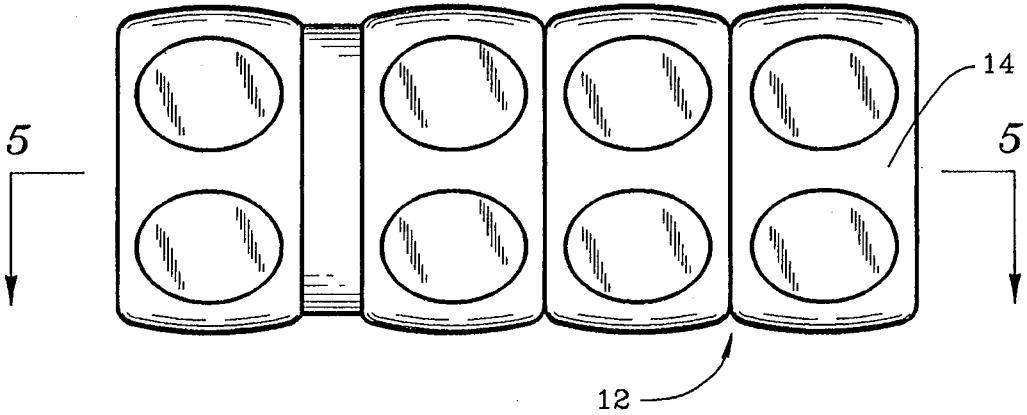
FIG. 3 is a top view of the housing in accordance with the present invention.

As seen in FIGS. 2 and 4 an insulator 58 is disposed within at least a portion of center pin 32 to prevent solder from entering the inside of center pin 32 when soldering the leading portion of the coaxial cable to first end 54 of center pin 32. Preferably, insulator 58 is Teflon tubing. The teflon insulator 58 inside center pin 32 preserves the inherent advantage of low "skin-effect" provided by the tubular structure of center pin 32.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A coaxial connector for connecting a coaxial cable to a female receptacle, the coaxial cable having a center conductor, the center conductor having an exposed leading portion, said connector comprising: a plug housing means having an inner surface and an outer surface; a plug having a body member and a hollow center pin, said plug operatively associated with said plug housing, the body member having a first end, a second end and a central portion therebetween, the leading portion of the center conductor operatively associated with the center pin; and means for preventing materials from entering said hollow center pin, wherein said means for preventing is an insulator disposed within at least a portion of said hollow center pin.

2. The coaxial connector of claim 1 wherein said insulator is Teflon tubing.

3. A coaxial connector for connecting a coaxial cable to a female receptacle, the coaxial cable having a center conductor, the center conductor having an exposed leading portion, said connector comprising: a plug housing means having an inner surface and an outer surface; a plug having a body member and a hollow center pin, said plug operatively associated with said plug housing, the body member having a first end, a second end and a central portion therebetween, the leading portion of the center conductor operatively associated with the center pin; and means for preventing materials from entering said hollow center pin, further comprising a biasing portion operatively associated with the central portion of said plug.

4. The coaxial connector of claim 3, wherein said biasing portion is defined by a plurality of cantilevered ground flanges, said ground flanges having a distal end and a proximal end, said ground flanges being separated from each other by longitudinally placed slits extending from the distal ends of said ground flanges to the proximal ends of said ground flanges and extending through said flanges from the inner surface to the outer surface of said flanges, said ground flanges being self biased by material construction, said ground flanges defining an outer circumference.

5. The coaxial connector of claim 4, wherein said biasing portion further defined by a means for adjustably biasing said ground flanges with the receptacle.

6. The coaxial connector of claim 5, wherein said means for adjustably biasing comprises at least one groove disposed about the outer circumference of said ground flanges and an O-ring disposed within said groove.

7. A coaxial connector for connecting a coaxial cable to a female receptacle, the coaxial cable having a center conductor, the center conductor having an exposed leading portion, said connector comprising: a plug housing means having an inner surface and an outer surface; a plug having a body member and a center pin, said plug operatively associated with said plug housing, the body member having a first end, a second end and a central portion therebetween, the leading portion of the center conductor operatively associated with the center pin; a plurality of cantilevered ground flanges operatively associated with said central portion, said ground flanges having a distal end and a proximal end, said ground flanges being separated from each other by longitudinally placed slits extending from the distal ends of said ground flanges to the proximal ends of said ground flanges and extending through said flanges from the inner surface to the outer surface of said flanges, said ground flanges being self biased by material construction, said ground flanges defining an outer circumference; and means for adjustably biasing said ground flanges with the receptacle, wherein said means for adjustably biasing comprises at least one groove disposed about the outer circumference of said ground flanges and an O-ring disposed within said groove.

8. The coaxial connector of claim 7 wherein said center pin is hollow.

9. The coaxial connector of claim 8 further comprising an insulator disposed within at least a portion of said hollow center pin.

10. The coaxial connector of claim 9 wherein said insulator is Teflon tubing.

11. A coaxial connector for connecting a coaxial cable to a female receptacle, the coaxial cable having a center conductor, the center conductor having an exposed leading portion, said connector comprising: a plug housing means having an inner surface and an outer surface, a portion of the inner surface having threads; and a plug defined by a hollow tubular body member with a continuous sidewall, said body member having a first end, a second end and a central portion therebetween, said body member having a means for aligning the coaxial cable at the first end of said body member, said central portion having a portion of said sidewall removed to define a means for accessing a first end of a hollow cylindrical center pin disposed within said body member, the center pin being firmly held at its first end to an annular insulating separator disposed within said central section, a portion of the first end of said center pin extending through the annular insulating separator for connection to the exposed leading portion of the center conductor, a portion of the remaining sidewall of said central section having outer surface threads, the outer surface threads of said central section operatively associated with said threads of the inner surface of said plug housing means, and a biasing portion operatively associated with the second end of said central section, said biasing portion having an inner surface and an outer surface.

12. The coaxial connector of claim 11, wherein said biasing portion is defined by a plurality of cantilevered ground flanges, said ground flanges having a distal end and a proximal end, said ground flanges being separated from each other by longitudinally placed slits extending from the distal ends of said ground flanges to the proximal ends of said ground flanges and extending through said flanges from the inner surface to the outer surface of said flanges, said ground flanges being self biased by material construction, said ground flanges defining an outer circumference.

13. The coaxial connector of claim 12, wherein said biasing portion further defined by a means for adjustably biasing said ground flanges with the receptacle.

14. The coaxial connector of claim 13, wherein said means for adjustably biasing comprises at least one groove disposed about the outer circumference of said ground flanges and an O-ring disposed within said groove.

15. The coaxial connector of claim 11, wherein said means for aligning the coaxial cable is a tubular cable aligning member disposed at the first end of said body member, wherein the leading portion of the coaxial cable is inserted through said tubular cable aligning member to allow the exposed leading portion of the cable to be operatively associated with the first end of the center pin.

16. The coaxial connector of claim 11, further comprising an insulating material disposed within at least a portion of the center pin.

17. The coaxial connector of claim 16, wherein said insulating material is Teflon tubing.

18. The coaxial connector of claim 12, wherein said ground flanges are constructed from a high conductive metal such as copper or silver.

* * * * *